United States Patent [19]

Hahn et al.

[11] Patent Number: 4,501,079

[45] Date of Patent: Feb. 26, 1985

[54] TWO PIECE CUTTING EDGE CONSTRUCTION

[75] Inventors: Frederick C. Hahn, Aloha; Larren F. Jones, Beaverton, both of Oreg.

[73] Assignee: ESCO Corporation, Portland, Oreg.

[21] Appl. No.: 526,001

[22] Filed: Aug. 24, 1983

[51] Int. Cl.[3] ..... E02F 3/76

[52] U.S. Cl. ..... 37/141 R; 24/456; 37/142 R; 172/701.3; 172/750; 299/92; 403/294; 403/327; 403/356

[58] Field of Search ..... 37/141 R, 141 T, 142 R, 37/142 A; 172/701.1, 701.3, 719, 753, 772, 772.5, 750; 403/327, 294, 356; 299/91, 92; 24/456

[56] References Cited

U.S. PATENT DOCUMENTS

| | | | |
|---|---|---|---|
| 3,520,076 | 7/1970 | Nichols | 37/141 R |
| 3,685,177 | 8/1972 | Hahn et al. | 37/141 R |
| 3,753,582 | 8/1973 | Graham | 37/142 A UX |
| 3,826,024 | 7/1974 | Petersen | 37/142 A |
| 3,864,853 | 2/1975 | Klett et al. | 37/141 T |
| 4,404,760 | 9/1983 | Hahn et al. | 37/142 R |

FOREIGN PATENT DOCUMENTS

| | | | |
|---|---|---|---|
| 247538 | 6/1966 | Austria | 403/327 |
| 681182 | 8/1979 | U.S.S.R. | 403/327 |

*Primary Examiner*—Edgar S. Burr
*Assistant Examiner*—Moshe I. Cohen
*Attorney, Agent, or Firm*—Tilton, Fallon, Lungmus & Chestnut

[57] ABSTRACT

A two-piece cutting edge construction wherein a plurality of adapters are mounted on the mold board each having releasably locked thereto a cutting edge; the sidewalls of the adapters and cutting edges being recessed for the receipt of longitudinally (forwardly/rearwardly) stabilizing pins; the lock for releasably coupling the cutting edge to the adapter including two legs resiliently inner connected by a compression spring with the lock being insertable and removable by forces extending transversely of the forward/rearward mounting and unmounting direction of the cutting edge.

13 Claims, 13 Drawing Figures

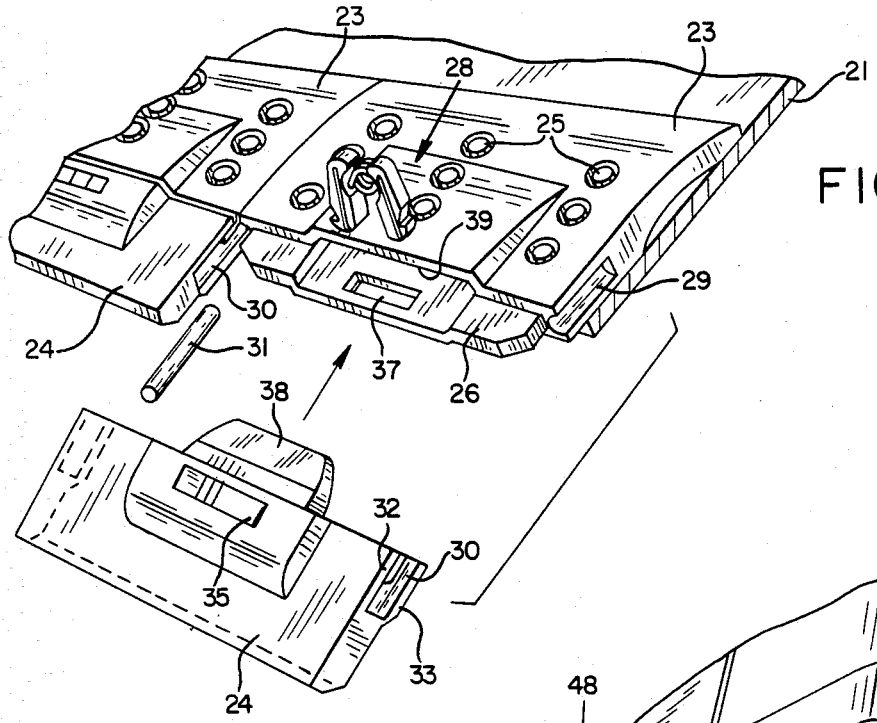
FIG. 6
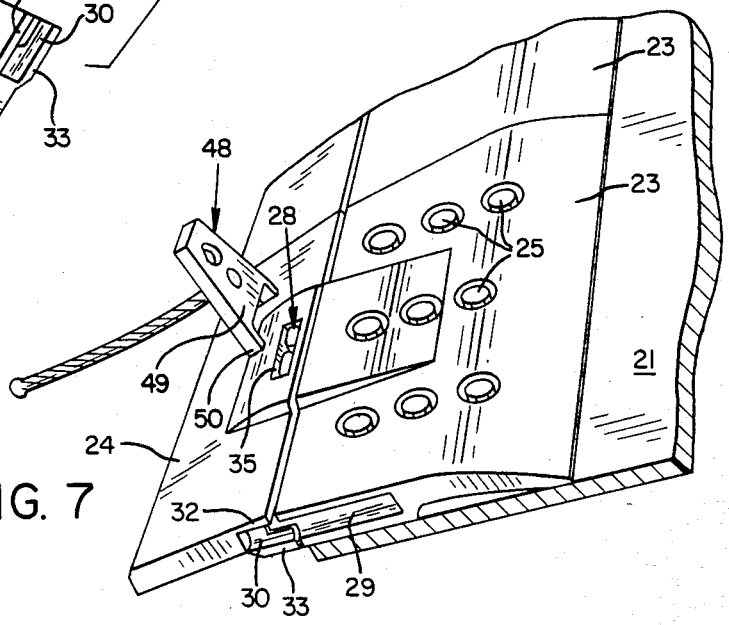
FIG. 7
FIG. 8
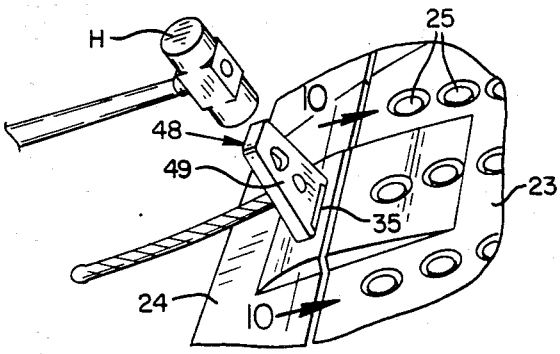
FIG. 9
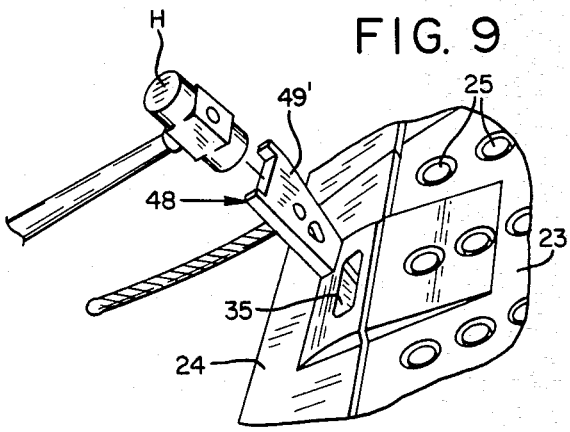

TWO PIECE CUTTING EDGE CONSTRUCTION

This invention relates to a two-piece cutting edge construction particularly suited for excavating equipment such as a scraper. It constitutes an improvement on co-owned U.S. Pat. No. 3,685,177.

BACKGROUND AND SUMMARY OF INVENTION

Although the structure of the above-mentioned '177 patent consistently received positive interest from customers, it did not enjoy commercial success because of the high price resulting from the high cost of manufacture. Instead, the earth moving art stayed with wrought steel cutting edges which were bolted to a single piece support member extending across the mold board of the scraper. These have been less than satisfactory because of the added cost of downtime and maintenance required to remove the bolts, replace the wrought steel cutting edges and rebolting, particularly since the machine must be moved to and from the maintenance shop to perform this work.

The first step toward remedying the high cost of the co-owned patent product and high cost of changing wrought steel cutting edges involved producing the adapters and edges in shorter segments measured across the mold board to a point where the adapters and edges were approximately halved in width. The resultant adapters and edges required additional support as the amount of flexure joints was at least doubled. Hence, the adapters and edges were stabilized into a load sharing mode by the introduction of longitudinally extending, i.e., in a direction forwardly/rearwardly of the scraper, pins which fit between and interlock adjacent to adapters and edges.

The second step involved overcoming premature lock ejection and attendant edge loss associated with the conventional steel pin and rubber plug considering that only one lock per edge/adapter is utilized in the cost reduction improvement. Added safety is also provided as smaller lighter tools can be used.

Other objects and advantages of the invention may be seen in the details of the ensuing specification.

The invention is explained in conjunction with the accompanying drawing, in which FIG. 1 is a fragmentary perspective view of an earth moving unit equipped with a two-piece cutting edge formed in accordance with the instant invention;

FIG. 6 is a fragmentary exploded perspective view of the parts of one portion of the cutting edge construction, viz., mold board, adapter, cutting edge, lock and stabilizing pin;

FIG. 7 is a fragmentary perspective view of an installed cutting edge construction along with the special removal tool employed for lock removal;

FIG. 8 is a view similar to FIG. 7 but with the removal tool partially inserted into the cutting edge opening for lock removal;

FIG. 9 is a perspective view such as FIG. 7 and FIG. 8 showing the final step in lock removal;

DETAILED DESCRIPTION

Figure 1:
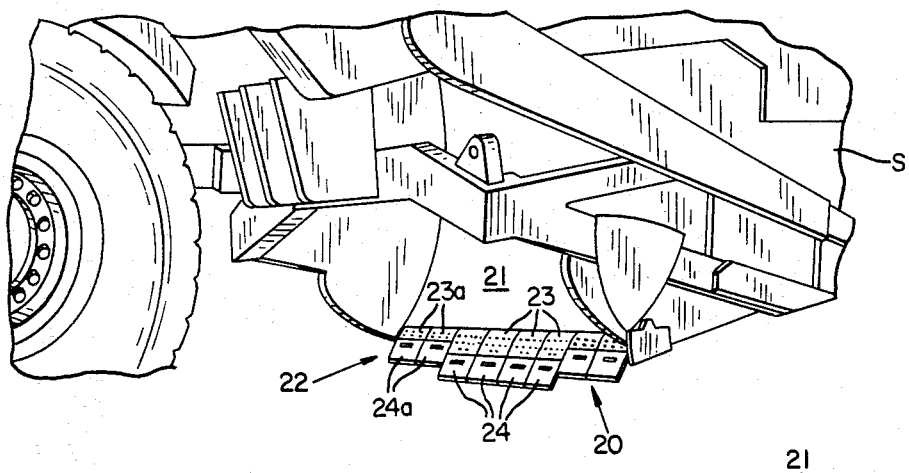

The invention will be explained in conjunction with a scraper blade assembly designated generally by the numeral 20 in FIG. 1 and which is provided as part of an earth moving vehicle S commonly used, for example, in the construction of roads. The invention is not limited to the cutting edge of scraper blades, however, and is applicable to almost any earth moving or digging equipment for which a replaceable cutting edge is desired. In this connection, reference may be had to the previously mentioned, co-owned U.S. Pat. No. 3,685,177 for additional details and background information.

The scraper blade 20 includes a conventional mold board 21 (compare FIGS. 1–3) and a replaceable two-piece cutting edge assembly designated generally by the numeral 22. The scraper blade of FIG. 1, for example, includes eight sets of adapter/cutting edge combination arranged in side-by side relationship. The four center sets can project further forwardly or be in line with respect to the two sets flanking each side. Each set includes an adapter part 23 and a cutting edge part 24 (compare FIGS. 2 and 3). All of the cutting edge parts 24 are identical—but the two outboard adapters and cutting edges flanking the four center adapters are somewhat shorter and are designated 23*a* and 24*a*, respectively, in FIG. 2. The exact relationship can vary to suit a particular make and model of machine.

Figure 3:
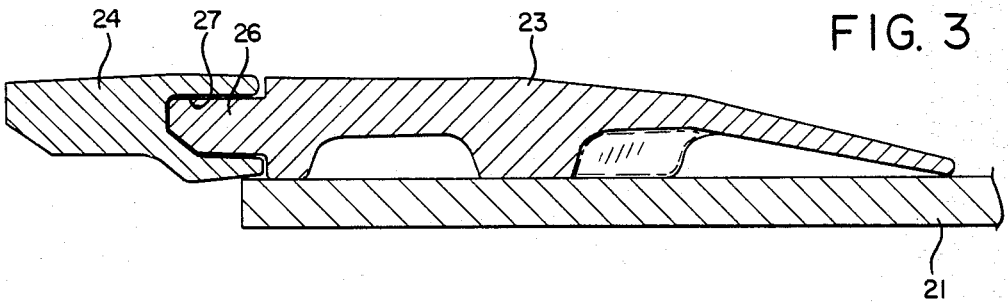
FIG. 3 is an enlarged sectional view taken along the sight line 3—3 of FIG. 2.
Figure 4:
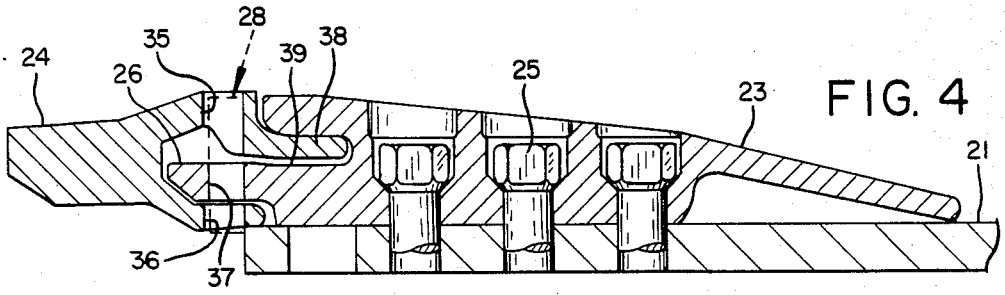
FIG. 4 is an enlarged sectional view taken along the sight line 4—4 of FIG. 2.

Each of the adapters 23 or 23*a* is secured to the mold board by means of a plurality of bolts as at 25 (see also FIG. 4). Each cutting edge 24 or 24*a* is secured to an associated adapter 23 (or 23*a* as the case may be) by means of a flange and pocket arrangement as at 26 and 27, respectively, in FIG. 3 and a rigid lock member generally designated 28 (see FIG. 4).

There are a number of unused holes in the assembly as at 25′ (see FIG. 2)—this was done to provide a maximum number of adapter patterns.

Figure 13:
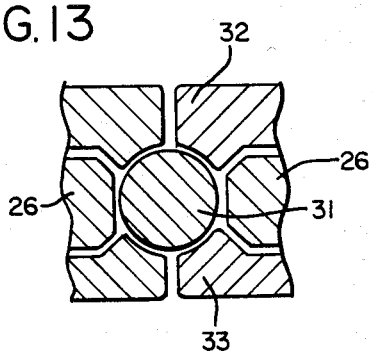
FIG. 13 is a view similar to FIG. 5 but taken along the sight line 13—13 of FIG. 2.

As can be best seen in FIG. 6, each sidewall of the adapter 23 is equipped with a recess as at 29 and each sidewall of the cutting edge 24 is equipped with a similar alignable recess as at 30—this for the receipt of an elongated interlocking pin 31. More particularly, each adjacent pair of adapters 23 or 23*a* and each adjacent pair of cutting edges 24 or 24*a* cooperate to provide portions of the generally tubular recess occupied by the pin 31. For example, where the pin is positioned rearward, i.e., in the direction of travel of vehicle S, of the cutting edges 24, the total recess is defined by hemicylindrical grooves 29 in the sidewalls of the adapters 23—see particularly FIG. 5. Further forward, however, the total recess occupied by the pin 31 is defined by grooves or reliefs in four parts—see FIG. 13. Referring again to FIG. 6. it will be noted that the recesses 30 in each cutting edge part provide, in effect, upper and lower walls as at 32 and 33, also in FIG. 13. In FIG. 6, the forwardly projecting flange 26 of the adapter 23 is seen to be narrower than the adapter itself and thus the middle, right and left hand portions in FIG. 13 of the recess providing parts are developed by the flanges 26 on adjacent adapters.

Figure 2:
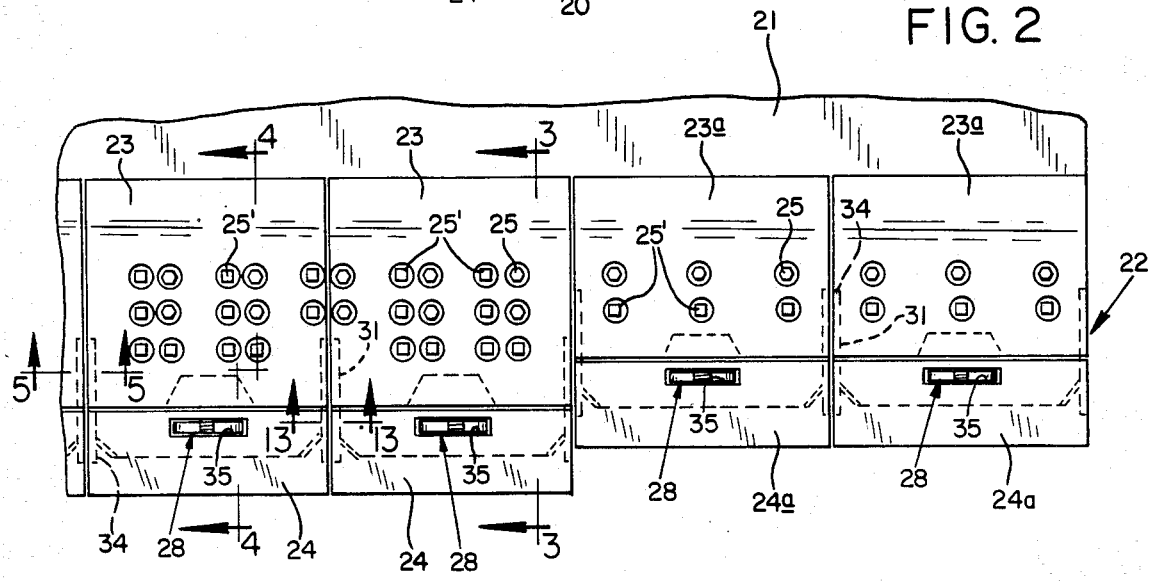
FIG. 2 is a fragmentary plan view of a portion of the earth engaging construction of FIG. 1.
Figure 5:
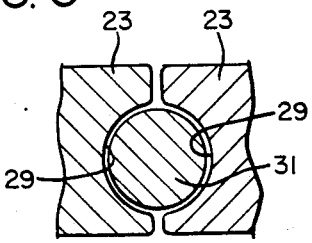
FIG. 5 is a fragmentary sectional view taken along the sight line 5—5 of FIG. 2.

The overall recess, whether it be defined solely by the adapters as in the FIG. 5 showing or by the adapters in combination with their associated cutting edges, extend partway along the length (in the forward/rearward direction) of both the adapters and cutting edges as can be most readily appreciated from a consideration of FIG. 2 where the overall tubular recesses are designated 34. The interlocking pins 31 act in longitudinal shear in resisting beam loading, viz., the generally vertical forces developed in digging and which extend perpendicularly to the longitudinal dimension of the vehicle S, again, the forward/rearward direction. It is preferred to use round bars or pins because of the easier castability and the ability to provide shear support even as the edge wears. However, square or hexagonal pins can be used, as well. The load sharing feature provided by the recesses 34 and pins 31 has made it possible to utilize adapters and cutting edges two or more times narrower than those depicted in the '177 patent and thereby achieves even better resistance to mold board flexure. When the scraper wear edges are moving through loose material, the pin 31 does not come into play. However when an embedded rock or a hard spot, like a dirt mogul, has been hit, the inventive structure has proven to be very successful in resisting breakage of the edge or adapter as the adjacent adapter and edge pick up some of the share of the load. In general, it has been found that the addition of the pins 31 increases the overall strength of the assemblies at least about 25%.

Lock

Figure 10:
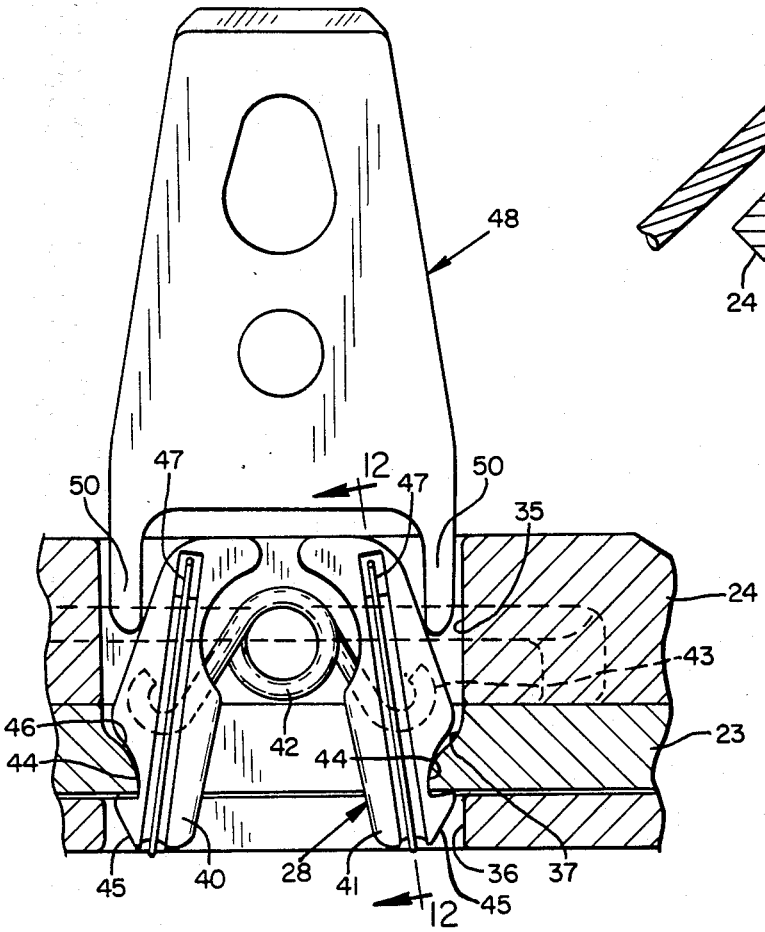
FIG. 10 is an enlarged fragmentary elevational view, partially in section, showing the details of the lock and removal tool such as would be seen along the sight line 10—10 of FIG. 8.
Figure 12:
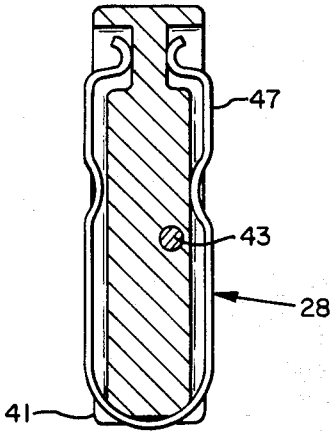
FIG. 12 is an enlarged sectional view taken along the sight line 12—12 of FIG. 10.

The lock 28 is seen in greater detail in FIGS. 10 and 12. It is positioned within the two spaced apart, aligned openings 35 and 36 of the cutting edge 24 (compare FIGS. 6 and 10) and the opening 37 in the flange 26 which is alignable with the openings 35 and 36 (compare FIGS. 6 and 10). For example, when the cutting edge 24 is moved rearwardly, i.e., in the direction of the arrow in FIG. 6, a rearwardly extending tang 38 on the cutting edge 24 enters the socket 39 provided on the top surface of the adapter 23. When the tang 38 is properly seated within the socket 39, the openings 35, 36 are aligned with the opening 37. Thereafter, the lock 28 can be inserted. The lock 28 differs from the usually-employed lock in that it is deformable for insertion or removal not by a force extending parallel to the direction of mounting movement (the arrow in FIG. 6) but is deformable by a force exerted transverse to this mounting direction. Thus, the lock 28 is effectively rigid as against forces extending forwardly/rearwardly of the assembled adapter and cutting edge.

For this purpose, the lock is constructed of two legs 40 and 41—see FIG. 10. The legs are connected together by means of a compression spring 42 which has its ends either cast or welded to the legs as indicated at 43 in FIGS. 10 and 12. Additionally, each leg 40, 41 is equipped with a notch as at 44 (see the left hand portion of FIG. 10) which engages a similarly contoured profile on the opening-providing sidewalls of the adapter 23, or 23*a*, i.e., the sidewalls of the opening 37.

Operation of Lock

When the openings 35–37 are aligned, the lock 28 is readily installed by pounding the same into place with a small sledge or hammer H such as is seen in FIG. 8 relative to lock removal. The compression spring 42 compresses under cam action developed by the inner play of the lower inclined surface 45 (again see the left hand portion of FIG. 10) against the shoulder-like profile 46 of the sidewall of the opening 37. As the lock is inserted further, the cam action between the surfaces 45 and 46 ceases and the compression spring 42 snaps the legs 40, 41 into place–in the position illustrated in FIG. 10.

To further keep the lock 28 from "rattling" (even though the same is under the influence of the compression spring 42), we provide additional springs as at 47. These C-shaped springs extend around the legs as illustrated in FIG. 12 and are somewhat compressed when the lock 28 is installed in the aligned openings. It will be appreciated that the tolerances in production parts are such as to provide a variation in the amount of spacing and thus the springs 47 can be used to prevent "rattling". However, these may be dispensed with because very often the openings become filled with impacted earth which itself is an anti-rattling means.

For removal, a special tool generally designated 48 can be employed to advantage. The tool 48 has a plate-like end 49 which is generally trapezoidal in shape and has depending feet 50—see FIG. 7. The larger end of the trapezoidal plate 49 is inserted into the upper opening 35 in the fashion seen in FIG. 8 and also depicted in partial section in FIG. 10. Force exerted by the hammer H causes the lock legs 40, 41 to be urged together under the influence of the feet 50 of the removal tool. This is, in effect, another damming action—the feet 50 moving down the exterior sloped walls of the legs 40, 41. This, in combination with the downward force applied to the plate 49 causes the lock 28 to be moved downwardly and partially out of the aligned openings 35–37.

Figure 11:
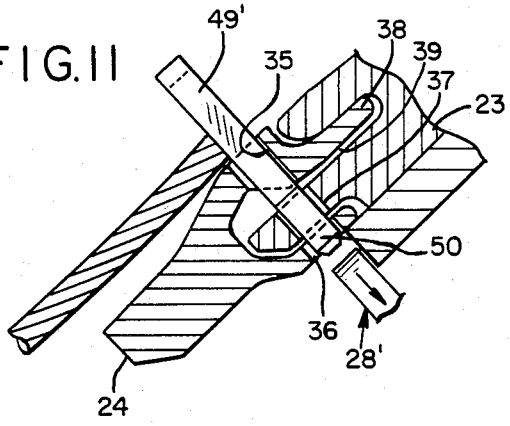
FIG. 11 is a fragmentary longitudinal sectional view showing the removal tool completely inserted into the aligned openings in the adapter and cutting edge and with the lock in the process of being completely removed.

Generally, this first removal action is insufficient to completely remove the lock 28 from the aligned openings 35–37. When this is the case, the plate 49 of the removal tool 48 is reversed in the fashion indicated at 49' in FIG. 9 and additional hammer blows apply to drive the plate 49' completely into the aligned openings 35–37 in the fashion depicted in FIG. 11 which also illustrates the ejection of the lock in fragmentary form as at 28'. Thereafter, the cutting edge 24 can be removed from the adapter 23.

Operation

The initial step in the assembly of the inventive two-piece cutting edge is to bolt a plurality of adapters 23 and 23*a* in side-by-side relation on the mold board 21. When it is desired to have certain of the cutting edges 24 project more forewardly, i.e., also downwardly, then the center and rearward row of bolt holes are used as opposed to the middle and forward row when an in-line cutting edge is desired.

Thereafter, the cutting edges 24 and 24*a* are installed in the fashion depicted in FIG. 6. A pin 31 is inserted into the recess 30 at the left hand portion of FIG. 6 and the cutting edges 24 and 24*a* moved rearwardly in the direction of the arrow in the central portion of FIG. 6. The rear edge or surface of the cutting edges 24 and 24*a* has generally a C-shape in vertical section as can be appreciated from a consideration of FIGS. 3 and 4. This extends across the entire width of the cutting edges 24 and 24*a* and accommodates the flange 26 which projects forwardly from the adapter 23. When the tang 38 enters the socket 39 and the openings 35, 36 are aligned with the opening 37, the lock 28 is inserted thereinto as by pounding with a hammer, sledge, mallet, etc. The details of insertion and removal are described hereinbefore under the heading "Operation of Lock". It will be appreciated that the lock, for example, may be employed in other earth working applications such as excavating teeth where the pocket and flange 26, 27 can take the form of a socket and nose.

While in the foregoing specification, a detailed description of an embodiment of the invention has been set down for the purpose of explanation, many variations in the details hereingiven may be made by those skilled in the art without departing from the spirit and scope of the invention.

We claim:

1. A multi-part cutting edge structure comprising: a plurality of adapter parts adapted to be secured to an earth moving unit in side-by-side relation and projecting forwardly therefrom, a cutting edge part adapted to be removably mounted on each adapter part by rearward movement relative thereto and projecting forwardly to provide side-by-side cutting edge parts, each of said parts being generally plate-like and having forwardly-extending side edges, each side edge having a forwardly-extending groove therein to cooperate with the groove of the adjacent part in defining a forwardly-extending, elongated, generally tubular recess, an elongated pin in each recess extending forwardly to span both a pair of adapter parts and their associated cutting edge parts to stabilize the same, each adapter part and the cutting edge part mounted thereon being equipped with alignable openings for the receipt of a lock, and a lock extending through said openings when aligned and rigidly coupling said parts together against forward disassembling movement of said cutting edge part, said lock including resilient means for lock removal by the application of a force transverse to the direction of said rearward movement.

2. The structure of claim 1 in which said lock includes a pair of legs adapted to extend vertically through said openings when said openings are aligned, said legs being coupled by spring means urging said legs apart transversely of the direction of said rearward movement.

3. The structure of claim 2 in which said legs are each equipped with a notch for resiliently engaging one of said parts.

4. The structure of claim 3 in which each adapter part is equipped with a forwardly projecting flange, each of said cutting edge parts being equipped with a rearwardly facing pocket defined by upper and lower walls in which said flange is positioned, said openings being located in said flange and the upper and lower walls, said notch flanking a portion of said flange.

5. A multi-part cutting edge structure comprising:

a plurality of adapter parts adapted to be secured to an earth moving unit in side-by-side relation and projecting forwardly therefrom, a cutting edge part adapted to be releasably secured to each adapter part and projecting forwardly to provide side-by-side cutting edge parts, each of said parts being generally plate-like and having forwardly-extending side edges, each side edge having a forwardly-extending groove therein to cooperate with the groove of the adjacent part in defining a forwardly-extending, elongated, generally tubular recess, an elongated pin in each recess extending forwardly to span both a pair of adapter parts and their associated cutting edge parts to stabilize the same, and lock means extending through aligned openings in each of said adapter and cutting edge parts and releasably coupling the same, said lock means including a pair of legs resiliently urged apart and equipped with latching surfaces for engagement with mating surfaces in one of said parts.

6. The structure of claim 5 in which said pin has a generally circular cross section.

7. The structure of claim 5 in which each said cutting edge parts has a C-shaped rear edge provided by a rear wall and spaced apart upper and lower walls which extend rearwardly from said rear wall, the associated adapter part having a front wall confronting said cutting edge part rear wall and flanked by the side walls of said adapter part, said recess being partially defined by said spaced apart upper and lower walls of said cutting edge part and said adapter sidewalls.

8. A multi-part cutting edge structure comprising:

a plurality of adapter parts adapted to be secured to an earth moving unit in side-by-side relation and projecting forwardly therefrom, a cutting edge part adapted to be releasably secured to each adapter part and projecting forwardly to provide side-by-side cutting edge parts, each of said parts being generally plate-like and having forwardly-extending side edges, each side edge having a forwardly-extending groove therein to cooperate with the groove of the adjacent part in defining a forwardly-extending, elongated, generally tubular recess, an elongated pin in each recess extending forwardly to span both a pair of adapter parts and their associated cutting edge parts to stabilize the same, and lock means releasably coupling each cutting edge part and its associated adapter part.

9. The structure of claim 8 in which each said cutting edge parts has a C-shaped rear edge provided by a rear wall and spaced apart upper and lower walls which extend rearwardly from said rear wall, the associated adapter part having a front wall confronting said rear wall and flanked by the side walls of said adapter part, said recess being partially defined by said spaced apart upper and lower walls and said adapter side walls.

10. The structure of claim 9 in which said lock means extends through aligned openings in each of said adapter and cutting edge parts and releasably coupling the same, said lock means including a pair of legs resiliently urged apart and equipped with latching surfaces for engagement with mating surfaces in one of said parts.

11. A multi-part cutting edge structure comprising:

a plurality of adapter parts to be secured to an earth moving unit in side-by-side relation and projecting forwardly therefrom, a cutting edge part adapted to be releasably secured to each adapter part and projecting forwardly to provide side-by-side cutting edge parts, lock means extending through aligned openings in each of said adapter and cutting edge parts and releasably coupling the same, said lock means including a pair of legs resiliently urged apart and equipped with latching surfaces for engagement with mating surfaces in one of said parts whereby said lock means is adapted to be removed by the application of a transverse force, each of said parts being generally plate-like and having forwardly-extending side edges, each side edge having a forwardly-extending groove therein to cooperate with the groove of the adjacent part in defining a forwardly-extending, elongated, generally tubular recess, an elongated pin in each recess extending forwardly to span both a pair of adapter parts and their associated cutting edge parts to stabilize the same.

12. The structure of claim 11 in which said legs are connected by a compression spring lying generally in a plane perpendicular to the direction of movement of said members for coupling, each leg being grooved for the receipt of a spring element lying generally in a plane parallel to said direction of movement.

13. The structure of claim 11 in which said legs have exterior camming surfaces below said latching surfaces for engagement with said shoulders and further camming surfaces above said latching surfaces for engagement with the feet of a removal tool.

* * * * *